United States Patent [19]

Hurd

[11] Patent Number: 5,075,514

[45] Date of Patent: Dec. 24, 1991

[54] INSULATED THERMOCOUPLE

[75] Inventor: John B. Hurd, Columbus, Ohio

[73] Assignee: Thermex, Inc., Columbus, Ohio

[21] Appl. No.: 567,313

[22] Filed: Aug. 14, 1990

[51] Int. Cl.[5] ..... H01B 7/08; H01B 7/34; H01B 13/06

[52] U.S. Cl. ..... 174/117 F; 156/53; 156/55; 174/112; 174/117 R; 174/121 R; 174/121 A; 174/122 G; 174/122 C; 174/124 GC

[58] Field of Search ..... 174/112, 117 R, 117 F, 174/121 R, 121 A, 121 AR, 121 SR, 122 R, 122 G, 122 C, 124 R, 124 G, 124 GC, 120 R, 120 C, 120 AR, 120 SR; 156/52, 53, 55; 136/226, 227, 235

[56] References Cited

U.S. PATENT DOCUMENTS

| | | | |
|---|---|---|---|
| 222,638 | 11/1940 | Szilard | 174/120 R |
| 2,243,560 | 5/1941 | Hall et al. | 174/121 SR |
| 2,365,019 | 12/1944 | Stewart | 174/120 SR |
| 2,370,046 | 2/1945 | Keyes | 174/120 R |
| 2,628,998 | 2/1953 | Frisbie | 174/112 |
| 2,795,640 | 6/1957 | Crandall | 174/120 R |
| 3,192,309 | 6/1965 | Zoder et al. | 174/121 R |
| 3,842,193 | 10/1974 | Johnson | 174/120 C |
| 3,900,701 | 8/1975 | Bayles et al. | 174/120 C |
| 4,430,384 | 2/1984 | George | 174/121 A X |
| 4,514,466 | 4/1985 | Leon, Jr. et al. | 174/121 A X |
| 4,598,018 | 7/1986 | Beuscher | 174/124 R |

FOREIGN PATENT DOCUMENTS

| | | | |
|---|---|---|---|
| 56380 | 5/1977 | Japan | 156/53 |

OTHER PUBLICATIONS

Sampson, Jr.; Fred F.; Applications of Fiberglas to Wire and Cable; *Wire;* paper presented before the Wire Associations Annual Convention at Buffalo, N.Y.; Oct. 1946; Published Nov. 1946; pp. 885–911.

*Fiberglas* Catalog; Electrical Insulation Materials; Catalog No. EL44-7, p. 1944, p. 10.

*Primary Examiner*—Morris H. Nimmo

*Attorney, Agent, or Firm*—Porter Wright Morris & Arthur

[57] ABSTRACT

An improved insulated thermocouple having no asbestos insulation material. The improved thermocouple and a method for making it are described whereby individual conductors are wrapped with high temperature fiberglass insulation and are then coated with a fiberglass binder that may be a modified silicone liquid. The individual conductors are then assembled in a parallel configuration and an outer jacket of high temperature fiberglass is applied by a braiding process. The entire assembly having the exposed outer jacket is coated with a fiberglass binder that may be a polyurethane liquid, and then cured.

13 Claims, 1 Drawing Sheet

INSULATED THERMOCOUPLE

BACKGROUND AND SUMMARY OF THE INVENTION

The present invention relates generally to insulated thermocouple wire and, more particularly, to an improvement in the material surrounding and insulating a thermocouple wire, the material not including asbestos Insulated wire used to "survey" or test a furnace, for example, to determine inside temperature of the furnace is a well-known product. Industrial furnaces, for example, may rise to extremely high temperatures requiring the survey wire to be sufficiently insulated. Previous insulated thermocouple wire has made use of asbestos for part of the insulation material. Due to the discovery that asbestos is a human health hazard, it is no longer acceptable as an ingredient for insulation. Asbestos has been used in combination with high temperature fiberglass to produce an insulation wrap around thermocouple wire. However, this combination of materials may not perform well above 1600° F. Therefore, a need exists for thermocouple insulation material that does not include asbestos and which can perform at temperatures above 1600° F.

It is an object of the present invention to fulfill the aforementioned needs. In the present invention, an insulated thermocouple wire is provided that can withstand temperatures of up to 2200° F. for an extended period of time. In a typical example, two single wires or conductors are double wrapped with S-2 fiberglass insulation along with a percentage of thermal adhesive material to cover 100% of the bare metal with insulation material. Each single conductor, now insulated, is coated with a fiberglass binder and then cured in a drying chamber. The second conductor or wire is prepared in the same manner as the first. The two conductors are then arranged parallel with each other and braided together with high temperature fiberglass insulation. The entire braided outer jacket is coated with a fiberglass binder. The assembly is then cured in a heat chamber. The foregoing and other objects and advantages will become more apparent when viewed in light of the accompanying drawings and following detailed description.

The present invention can also be used to insulate other types of wire besides thermocouple wire.

For example, instrument hook-up wire can use the process of the present invention to provide an asbestos free, high temperature environment for the hook-up wire.

DESCRIPTION OF A PREFERRED EMBODIMENT(S)

Figure 1:
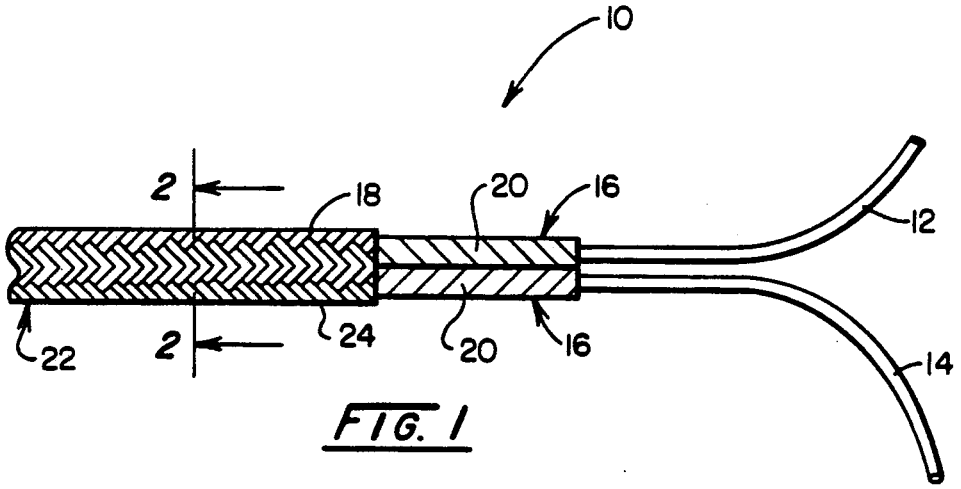
FIG. 1 is a partial, cut-away, plan view of the thermocouple of the present invention.
Figure 2:
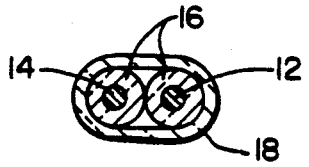
FIG. 2 is a section view of the thermocouple of FIG. 1, taken along Line 2—2 of FIG. 1.

Referring now to the drawings, and particularly FIG. 1, there is illustrated a typical thermocouple assembly generally indicated at 10 and of a type widely known in the thermocouple industry. The thermocouple assembly 10 may be comprised of two wires or conductors 12, 14 which are first individually wrapped with an insulation material 16 and then braided together in a parallel fashion also with an insulation material 18. Those of ordinary skill in the art will recognize the difference between wrapping and braiding.

Starting with a single conductor 12, the conductor 12 may be a wire material such as chromel ®, for example, which is a thermoelectric element. The second conductor 14 may be of the material alumel ® for example, which, like chromel ® is a high nickel alloy thermoelectric element. Other first and second wire materials may be used that would be included in the classifications of type K or type N as designated by NIST, ISA, and/or ANSI. One of the conductors 12 may act as a positive conducting leg and the other wire or conductor 14 may act as a negative conducting leg.

Each conductor wire 12, 14 is first individually wrapped with fiberglass insulation 16. A preferred fiberglass may be S-2. The wrapping of the fiberglass 16 around the wire 12 may be accomplished in several ways known to those of ordinary skill in the art but probably primarily by use of a wrapping machine. After the conductor 12 is wrapped with the insulation 16, it is then coated (saturated) with a fluid type carrier 20 that acts as a fiberglass binder. Modified silicone liquid may be used for this purpose. The silicone liquid may be modified by adding approximately one-quarter pound per gallon of mica powder. The conductor 12 may then be cured in one preferred manner at approximately 450° F. in a continuous drying heat chamber (not shown). In one preferred embodiment, the wall thickness of the fiberglass insulation around a 20 AWG conductor 12 is approximately .001 inch while the added wall thickness due to the fiberglass binder is approximately .0001–.0002 inch.

The second conductor wire 14 is wrapped and coated in the same manner as the first 12. Then in combinations of two or more conductor wires in parallel configuration, the insulated and coated wires 12, 14 are braided together with high temperature fiberglass insulation 18. Braiding may be accomplished by a known braider machine. Once again, this high temperature braided fiberglass layer 18 may be S-2 fiberglass. After braiding, the jacket 22 may be coated with a fluid carrier 24 acting as a fiberglass binder. Polyurethane liquid which may be a polyvinyl resin that is water soluble may be used in this capacity. The entire assembly may then be cured; in one preferred embodiment at approximately 150° F. to 220° F. in a heat chamber. The fiberglass binder coating 24 on the outer jacket 22 minimizes any fraying characteristics. Fiberglass binders other than those mentioned above could also be used in an appropriate application.

The entire assembly 10 may be color-coded to agree with industry standard usage. The wrapping 16 around the negative leg 12 may be red and the wrapping 16 around the positive leg 14 may be white. The overall braided outer jacket 22 may be white. Any industry accepted color code could be used. The entire assembly 10 having the individually wrapped conductor wires 12, 14 braided together offers 100% protection of the wire 12, 14.

It is thought that the improved insulated thermocouple of the present invention and many of its attendant advantages will be understood from the foregoing description and it will be apparent that various changes may be made in the form and construction of the components thereof without departing from the spirit and scope of the invention or sacrificing all of its material advantages, the form hereinbefore described being merely a preferred or exemplary embodiment thereof.

What is claimed is:

1. An improved wire assembly comprising:

a first conductor wrapped with high temperature fiberglass;

a second conductor wrapped with high temperature fiberglass; and said first conductor and said second conductor assembled in parallel configuration and braided together with high temperature fiberglass.

2. The wire of claim 1, further comprising:

said first conductor coated with a fiberglass binder; and said second conductor coated with a fiberglass binder.

3. The wire of claim 1, further comprising:

said braided fiberglass coated with a fiberglass binder.

4. The wire of claim 2, wherein said fiberglass binder is a modified silicone liquid to which has been added mica powder.

5. The wire of claim 3, wherein said fiberglass binder is a polyurethane liquid.

6. The wire of claim 1, wherein said wrapped fiberglass is color-coded.

7. A method for making an improved wire assembly for a thermocouple comprising the steps of:

wrapping a first conductor with high temperature fiberglass insulation;

wrapping a second conductor with high temperature fiberglass insulation;

assembling said first conductor and said second conductor in parallel configuration; and braiding an outer jacket around both said first and said second conductors with high temperature fiberglass.

8. The method of claim 7, wherein said outer jacket is formed by braiding a high temperature fiberglass insulation around said first wrapped conductor and said second wrapped conductor.

9. The method of claim 7, further comprising:

coating the wrapped fiberglass around said first conductor with a modified silicone liquid to which has been added mice powder; and coating said fiberglass insulation around said second conductor with said modified silicone liquid.

10. The method of claim 9, further comprising:

curing said first and said second conductors in a heat chamber prior to forming said outer jacket.

11. The method of claim 7, further comprising:

coating said outer jacket with a polyurethane liquid.

12. The method of claim 11, further comprising:

curing said assembly in a heat chamber for a predetermined time and at a predetermined temperature.

13. A method for making an improved wire assembly for a thermocouple comprising the steps of:

wrapping a first conductor with high temperature fiberglass insulation;

coating said wrapped first conductor with a silicone liquid modified with mica powder;

wrapping a second conductor with high temperature fiberglass insulation;

coating said wrapped second conductor with said silicone liquid modified with mica powder;

curing said first and said second coated conductors in a heat chamber at a predetermined temperature;

arranging said conductors in close parallel configuration; braiding an outer jacket of high temperature fiberglass insulation around said conductors;

saturating said outer jacket in a polyurethane liquid; and curing said assembly in a heat chamber.

* * * * *